US007798151B2

(12) United States Patent
Krukonis et al.

(10) Patent No.: US 7,798,151 B2
(45) Date of Patent: Sep. 21, 2010

(54) REDUCTION OF CONSTITUENTS IN TOBACCO

(75) Inventors: Val Krukonis, Lexington, MA (US); Hans Schonemann, Newburyport, MA (US); Anthony Gudinas, Atkinson, NH (US); Paula M. Wetmore, Chelmsford, MA (US); Kara Williams, Saugus, MA (US); Carl H. Midgett, Ashland City, TN (US); Clifford Brown Bennett, Brentwood, TN (US); Harry Y. Zheng, Smyrna, TN (US); Kathleen S. Johnston, Nashville, TN (US)

(73) Assignees: US Smokeless Tobacco Co., Greenwich, CT (US); Phasex Corporation, Lawrence, MA (US)

( * ) Notice: Subject to any disclaimer, the term of this patent is extended or adjusted under 35 U.S.C. 154(b) by 1166 days.

(21) Appl. No.: 10/623,006

(22) Filed: Jul. 18, 2003

(65) Prior Publication Data

US 2004/0112394 A1 Jun. 17, 2004

Related U.S. Application Data

(60) Provisional application No. 60/397,060, filed on Jul. 18, 2002.

(51) Int. Cl.
*A24B 3/18* (2006.01)

(52) U.S. Cl. ..... 131/296; 131/298

(58) Field of Classification Search ..... 131/291, 131/296, 298, 900
See application file for complete search history.

(56) References Cited

U.S. PATENT DOCUMENTS 2,128,043 A * 8/1938 Garner ..... 546/279.4
2,227,863 A 1/1941 Rhodes
3,126,011 A * 3/1964 Haden et al ..... 131/352
3,390,685 A 7/1968 Von Bethmann et al.
3,577,997 A * 5/1971 Bindig ..... 131/352
4,153,063 A * 5/1979 Roselius et al. ..... 131/297
4,200,113 A * 4/1980 Schmidt ..... 131/298
4,211,243 A * 7/1980 Ohno et al. ..... 131/296
4,333,483 A * 6/1982 de la Burde et al. ..... 131/352
4,506,682 A * 3/1985 Muller ..... 131/297
4,561,452 A 12/1985 Gährs
4,714,617 A 12/1987 Gährs
4,727,889 A 3/1988 Niven, Jr. et al. ..... 131/297
4,805,642 A 2/1989 Rainer (Continued)

FOREIGN PATENT DOCUMENTS

DE 4416785 11/1995

(Continued)

OTHER PUBLICATIONS

Chortyk et al. The Application of Solid Phase Extraction to the Analysis of Tobacco-Specific Nitrosamines. J. Chromatog. Sci. 1991, 29:522-527.

(Continued)

*Primary Examiner*—Carlos Lopez
(74) *Attorney, Agent, or Firm*—Clark & Elbing LLP

(57) ABSTRACT

Methods of selectively reducing constituents in tobacco as well as the tobacco obtained by such methods are disclosed. Subcritical fluids, e.g., liquid carbon dioxide, serve as the reduction media.

43 Claims, 2 Drawing Sheets

U.S. PATENT DOCUMENTS

| | | | | |
|---|---|---|---|---|
| 4,898,188 | A | 2/1990 | Niven, Jr. et al. | |
| 4,967,771 | A | 11/1990 | Fagg et al. | |
| 5,012,827 | A | 5/1991 | Beutler et al. | |
| 5,018,540 | A | 5/1991 | Grubbs et al. | |
| 5,076,293 | A | 12/1991 | Kramer | |
| 5,119,835 | A | 6/1992 | Heemann et al. | |
| 5,472,612 | A | 12/1995 | Maxwell | |
| 5,497,792 | A | 3/1996 | Prasad et al. | |
| 5,810,020 | A | 9/1998 | Northway et al. | |
| 6,048,404 | A * | 4/2000 | White | 131/275 |
| 6,209,546 | B1 * | 4/2001 | Baehl et al. | 131/291 |
| 2004/0049059 | A1 | 3/2004 | Mueller | |

FOREIGN PATENT DOCUMENTS

| | | |
|---|---|---|
| EP | 0280817 | 9/1988 |
| EP | 0283257 | 9/1988 |
| EP | 0908185 | 4/1999 |
| JP | 64-74962 | 3/1989 |
| JP | 05329301 | 12/1993 |
| JP | 08-23952 | 1/1996 |
| JP | 2002-503965 | 5/2002 |
| WO | WO 98/58555 | 12/1998 |
| WO | WO 01/65954 A1 | 9/2001 |
| WO | WO 02/00040 | 1/2002 |
| WO | WO 02/28209 | 4/2002 |
| WO | WO 02/32420 | 4/2002 |

OTHER PUBLICATIONS

Prokopczyk et al. Supercritical Fluid Extraction in the Determination of Tobacco-Specific *N*-Nitrosamines in Smokeless Tobacco. Chem. Res. Toxicol. 1992, 5:336-340.

Prokopczyk et al. Improved Methodology for the Quantitative Assessment of Tobacco-Specific N-Nitrosamines in Tobacco by Supercritical Fluid Extraction. J. Agric. Food Chem. 1995, 43:916-922.

Song et al. Supercritical Fluid Extraction and Gas Chromatography/Mass Spectrometry for the Analysis of Tobacco-Specific Nitrosamines in Cigarettes. Anal. Chem., 1999, 71:1303-1308.

English language translation of Reasons for Rejection from Japanese Patent Application No. 2004-523607, mailed Oct. 26, 2009.

Examiner's First Report for Australian Patent Application No. 2003261187, mailed Nov. 11, 2008.

First Office Action in Chinese Patent Application No. 03817167.8, stamped Jun. 23, 2006 (English translation provided).

Supplementary European Search Report for European Patent Application No. 03765770, completed Jun. 17, 2005, mailed Aug. 11, 2005.

Communication in European Patent Application No. 03765770, mailed Jul. 15, 2009.

Office Action in Korean Patent Application No. 10-2005-7000847, mailed Oct. 13, 2009 (English summary provided).

English Translation of Reasons for Rejection in Japanese Patent Application No. 2004-523607, received Nov. 20, 2008.

International Search Report for PCT/US03/22585, completed Nov. 2, 2003, mailed Dec. 9, 2003.

International Preliminary Examination Report for PCT/US03/22585, completed Dec. 20, 2004.

Written Opinion of the International Searching Authority for PCT/US03/22585, mailed Apr. 9, 2004.

Final Office Action issued in Korean Patent Application No. 10-2005-7000847 dated Jun. 9, 2010, including associate's Report of Action in English language.

* cited by examiner

REDUCTION OF CONSTITUENTS IN TOBACCO

CROSS-REFERENCE TO RELATED APPLICATIONS

This application claims benefit of U.S. Provisional Application No. 60/397,060, filed Jul. 18, 2002, hereby incorporated by reference.

BACKGROUND OF THE INVENTION

The present invention relates to tobacco (*Nicotiana* spp.) and preparations thereof that have reduced concentrations of certain constituents.

Plants contain a myriad of compounds that have industrial, agricultural, and medical uses. Such compounds may often be obtained by extraction using a variety of methods. In addition, plant matter itself is often employed in a variety of industries, e.g., textiles, and the chemical content of the plant matter may be altered prior to use, for example, by extraction processes, chemical treatment, heat treatment, or biological treatment.

Several processes have been employed to extract compounds from plant matter. For example, extractions have employed aqueous based and organic solvents, gases, and supercritical fluids. The process employed determines the compounds that are removed from the plant matter and the compounds that are retained in association with the plant matter.

In addition, the various processes used for extraction may differ according to cost, equipment needs, hazardous nature of the chemicals, complexity of the extraction, and adverse affects on the plant matter. For example, supercritical extraction in the manufacture of a plant-based product may negatively impact the economic feasibility of commercialization because the process is complex and expensive and requires specialized equipment. Other extraction methods may have a lower cost and be less complex but lead to an unsatisfactory product, e.g., one that has a negatively impacted flavor, aroma, or quality. Other processes may also be difficult to employ on a scale suitable for mass production.

Thus, there is a need for a simple, scaleable, environmentally sound, and commercially viable process to reduce unwanted constituents in plant matter, such as tobacco, without otherwise substantially altering the attributes of the product.

SUMMARY OF THE INVENTION

The invention features methods of reducing the amount of constituents in tobacco, as well as the tobacco obtained by such methods. More specifically, such methods are performed on the tobacco itself rather than on aqueous tobacco extracts. These methods are capable of reducing constituents without significant reduction in tobacco attributes. For example, the methods of the invention may be used to reduce secondary alkaloids selectively compared to primary alkaloids.

Accordingly, the invention features a method of reducing an amount of a constituent, e.g., a secondary alkaloid or polycyclic aromatic hydrocarbon (PAH), in tobacco by providing a vessel containing tobacco comprising the constituent; contacting the tobacco with a subcritical fluid; and removing the subcritical fluid from the vessel, e.g., by venting to the atmosphere or a second vessel. Preferably, the methods of the invention selectively reduce the amount of the constituent relative to a primary alkaloid.

In another aspect, the invention features a method of reducing the amount of a constituent in tobacco by providing a plurality of valved vessels connected to form a system, wherein the plurality of vessels contains tobacco comprising the constituent; contacting tobacco in a first vessel with a subcritical fluid; removing the subcritical fluid from the first vessel; and directing subcritical fluid, e.g., that from the first vessel, to a second vessel, to additional vessels, or to a waste vessel (or vented to atmosphere) as desired. The method may further include the steps of isolating the first vessel (or any other) from the system; and removing the tobacco from the first vessel, wherein the tobacco has a reduced amount of the constituent. This further step may occur before, during, or after the subcritical fluid has been removed from the first vessel.

In various embodiments of the above aspects of the invention, the method may include the step of separating a constituent from the subcritical fluid. This separation from the subcritical fluid may include the step of flowing the subcritical fluid containing the constituent into a second vessel that may or may not contain a substance capable of extracting a given constituent from the subcritical fluid. Exemplary substances include solid citric acid, an aqueous solution of citric acid, activated carbon, and solid magnesium silicate. Upon exiting a vessel or entering a second vessel (e.g., a separator vessel), the pressure or temperature of the subcritical fluid may be changed. In certain embodiments, a decrease in pressure causes a precipitation of the dissolved constituents. In other embodiments, the method further includes recirculating the subcritical fluid, after separation of the constituent, to a vessel containing tobacco. During recirculation, any flavor or aroma compounds removed from the tobacco with a constituent may be redeposited in the tobacco.

A variety of subcritical fluids, as disclosed herein, may be employed in the methods of the invention. The temperature and pressures employed for each subcritical fluid (or mixture thereof) may vary depending on the subcritical fluids employed. The subcritical fluid may be in liquid form, e.g., a compressed gas, or in gas form.

In various embodiments, the methods reduce the amount of a constituent, e.g., secondary alkaloids or PAHs, in the tobacco by at least 10%, 20%, 30%, 40%, 50%, 60%, 70%, 75%, 85%, or 95%.

In yet another embodiment, the methods selectively reduce the amount of a constituent, e.g., secondary alkaloids or PAHs, in the tobacco by at least 10%, 20%, 30%, 40%, 50%, 60%, 70%, 75%, 85%, or 95%. The methods preferably retain at least 30%, 40%, 50%, 75%, 85%, 95%, or 99% of a primary alkaloid or a particular attribute, such as flavor or aroma compounds.

The tobacco employed typically has a moisture content of between 5-60%, e.g., at least 10%, 15%, 20%, 30%, 40%, or 50%. The pH of the tobacco is typically between 4 and 9, e.g., at least pH 5, 6, 7, or 8.

The invention further features tobacco or a tobacco product treated by the above-described methods.

By a "chlorofluorocarbon" is meant a compound including only carbon, fluorine, and chlorine atoms.

By a "chlorofluorohydrocarbon" is meant a compound including only carbon, hydrogen, fluorine, and chlorine atoms.

By "constituent" is meant secondary alkaloids and polycyclic aromatic hydrocarbons (PAH) found in tobacco. By "PAHs" is meant anthracene, anthanthrene, benzo(a)pyrene, coronene, fluoranthene, fluorene, naphthalene, phenanthrene, pyrene, and perylene. By "secondary alkaloid" is meant N-nitrosodimethylamine, N-nitrosodiethylamine, N-nitrosopyrrolidine, N-nitrosodiethanolamine, N-nitrosonornicotine (NNN), 4-(methylnitrosamino)-1-(3-pyridyl)-1-butanone (NNK), N-nitrosoanatabine (NAT), or N-nitrosoanabasine (NAB).

By "primary alkaloid" is meant any alkaloid other than a secondary alkaloid.

By "tobacco attribute" is meant a flavor or aroma compound.

By a "hydrocarbon" is meant a compound including only carbon and hydrogen atoms.

By "reducing" is meant a lowering the detectable amount of a constituent in tobacco.

By "subcritical fluid" is meant a compound, or mixture of compounds, that is a gas at ambient temperature and pressure. The term encompasses both the liquid and gaseous phases for such a compound. Exemplary subcritical fluids include, without limitation, carbon dioxide, chlorofluorocarbons, chlorofluorohydrocarbons (e.g., Freon 22), hydrocarbons (e.g., ethane, propane, and butane), nitrous oxide, and combinations thereof.

By "tobacco" is meant any part of any member of the genus *Nicotiana*, e.g., leaves and stems. The tobacco may be whole, shredded, cut, cured, fermented, or otherwise processed. Tobacco may also be in the form of finished products, including but not limited to smokeless tobacco, snuff (moist or dry), chewing tobacco, cigarettes, cigars, and pipe tobacco.

DETAILED DESCRIPTION OF THE INVENTION

Laboratory scale and suitable industrial scale methods of selectively reducing the amount of certain constituents in tobacco are described along with test data detailing the effectiveness of such methods. Notably, these methods are performed on tobacco itself. In addition, the tobacco can be from any source, including dried, cured, or processed, and can further be in the form of finished products, e.g., cigarettes, snuff (moist or dry), and cigars. These methods can reduce the amount of one or more constituents without substantially removing tobacco attributes.

Figure 1:
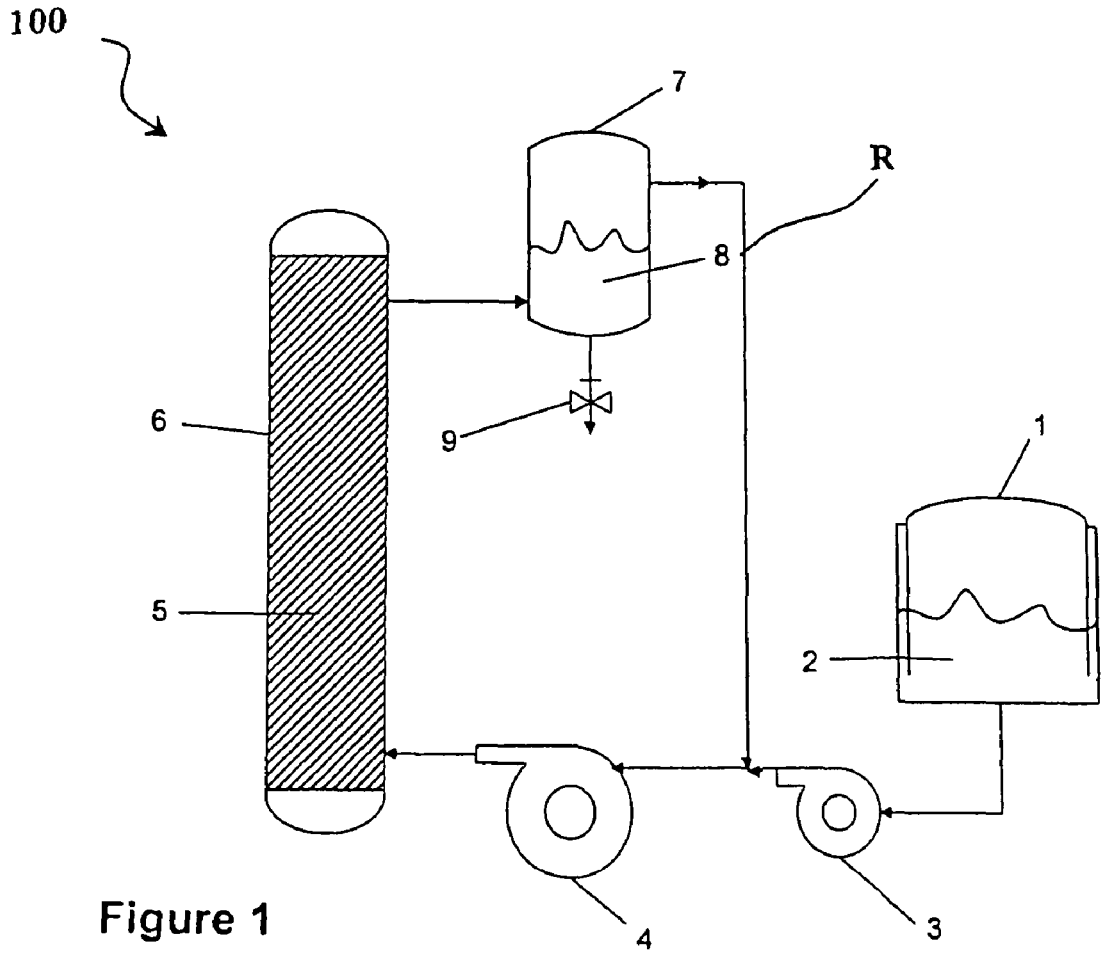
FIG. 1 is a schematic representation of a system suitable for an industrial setting, utilizing, e.g., liquid carbon dioxide under subcritical conditions to reduce the amount of a constituent in tobacco.

As shown in FIG. 1, an industrial type system utilizing, e.g., liquid carbon dioxide under subcritical conditions, can be used to reduce the amount of one or more constituents in tobacco. Although only one vessel 6 is shown in FIG. 1, it is understood that a plurality of such vessels can be utilized, in series, in a large-scale system.

As further shown in FIG. 1, tobacco 5 is charged to vessel 6, which is then sealed so as to be able to operate under elevated pressure conditions, e.g., necessary to maintain a subcritical fluid as a liquid therein. Subcritical fluid 2, e.g., carbon dioxide, initially stored as shown in supply vessel 1, is directed through and is pumped to a desired pressure by inlet pump 3. After pressurized subcritical fluid 2 passes through inlet pump 3, the liquid proceeds, via circulation pump 4 into vessel 6 and through the charge of tobacco 5. As the liquid subcritical fluid 2 flows through tobacco 5, the amount of constituents in tobacco 5 is reduced. After exiting vessel 6, a subcritical fluid stream, which at this point may be gaseous, flows into and through separator vessel 7. The separator vessel may contain a substance 8, which traps basic constituents and, thereby, depletes the subcritical fluid of any dissolved or suspended constituents. The substance 8 can be drained from separator vessel 7 via drain valve 9, particularly after the solution accumulates a significant amount of constituents. A suitable substance 8 is an aqueous citric acid solution. Other possible substances effective for separating out constituents include, for example, solid magnesium silicate or any other such solution or solid capable of binding the desired constituents.

The subcritical fluid, once depleted of any dissolved or suspended constituents may be recirculated to the vessel 6, as shown, via line R. Circulation pump 4 may be designed such that subcritical fluid entering its inlet from line R may, once again, be pressurized so as to liquefy before entering vessel 6. Those having ordinary skill in the art will recognize that pump 4 may thus act to re-pressurize the subcritical fluid entering pump 4 from either supply vessel 1 or line R. Following completion of the reduction process, the system may be depressurized and constituent-reduced tobacco 5 removed. The process time may vary depending on a variety of processing parameters. One of ordinary skill in the art will readily be able to determine suitable process times. Ranges of appropriate process times are discussed below in connection with trial runs performed on a laboratory-scale system.

The virtually continuous circulation of subcritical fluid and the inherent capability of reducing constituents from multiple charges of tobacco residing in a plurality of vessels are two clear advantages to be exploited. Elimination of costly down time brought about by emptying and recharging of a single vessel 6 is achievable with use of several (typically three or four) valved vessels 6 operating in series. Vessels may also be operated in parallel. As noted above, subcritical fluid is pumped in series through the several vessels 6. When the charge of tobacco in one of the vessels has become constituent-reduced and is ready to be removed, the subcritical fluid can be diverted from that vessel to another vessel containing tobacco or a separation vessel. This subcritical fluid may still be effective for reducing constituents from other charges of tobacco in other vessels. The vessel from which tobacco is ready to be removed may be isolated from the system without interfering with on-going reductions in other vessels. New tobacco may then be placed into the vessel, and the process can continue without overall system interruption.

Preferably, treated tobacco substantially retains the taste and aroma of untreated tobacco. Alternatively, any flavor or aroma compounds removed during treatment may be re-deposited in the tobacco, e.g., after removal of any constituents from the subcritical fluid. The flavor and aroma content of tobacco can be determined by taste and smell tests.

The following examples illustrate various embodiments of the present invention and are not intended to be limiting in any way.

Example 1

Reduction of Constituents Using Subcritical Carbon Dioxide

Figure 2:
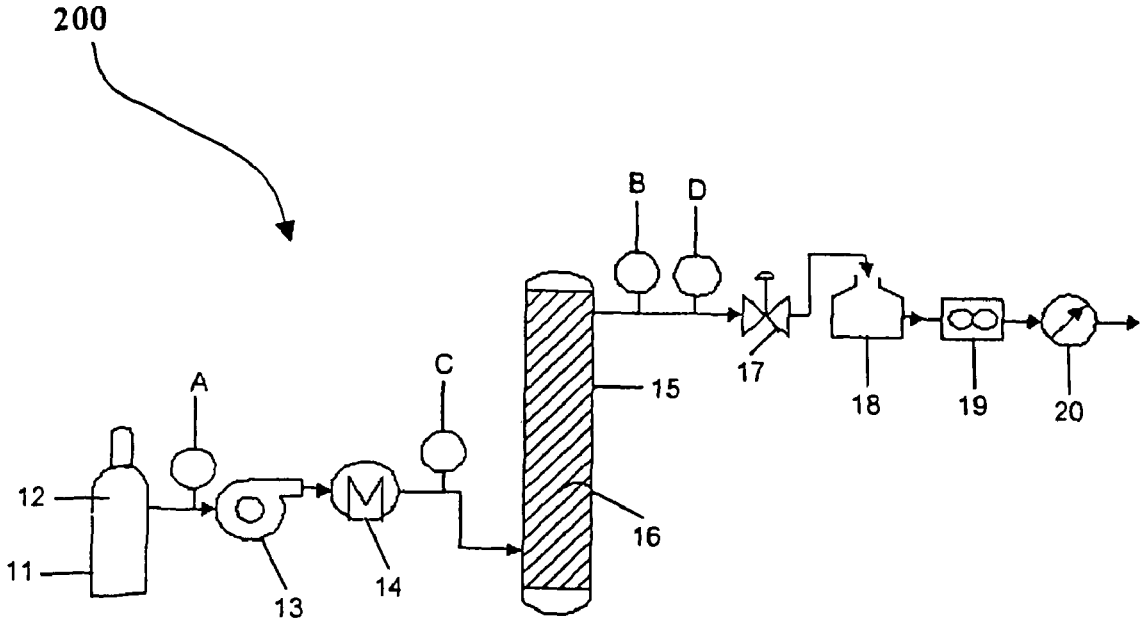
FIG. 2 is a schematic representation of a laboratory-scale apparatus, e.g., utilizing liquid carbon dioxide under subcritical conditions to reduce the amount of a constituent in tobacco.

FIG. 2 shows a schematic representation of a laboratory-scale system that can be used to produce reduced constituent content in tobacco. The representative data of Table 1 were developed using such a system, which was operated in the following manner. A sample of tobacco 16 was placed in vessel 15, and the vessel was sealed. Gaseous subcritical fluid 12 was supplied from cylinder 11 and admitted to the system. When pressure (as measured by gauges A and B) reached cylinder pressure, compressor pump 13 was energized to liquefy the fluid 12. Temperature was adjusted and controlled using preheater 14 and was measured with thermocouples C and D. Flow of subcritical fluid 12 was then started using adjustable flow control valve 17 that was set so as to operate at a selected flow rate measured by flow meter 19. The range of flow rate may be between about 5 grams/min to 150 grams/min; for convenience 20-30 grams/min rate was chosen for the experimental runs. Pressure was reduced across valve 17, resulting in the gaseous subcritical fluid passing into filter flask 18 into which constituent-rich extract could be collected. Alternatively, the subcritical fluid was vented to a waste vessel. The total flow of subcritical fluid 12 passed through the charge of tobacco 16 during the duration of a run was measured by dry test meter 20. In this laboratory system, no separation vessel was used to facilitate recirculation of subcritical fluid 12. Vessel 15 was a stainless steel tube having a length of 10 inches, an outside diameter of 1 inch, and a volume of about 60 ml. After treatment, the tobacco 16 was analyzed for its constituent content and the percent reduction of constituent content. The run time necessary to produce such tobacco may be anywhere between about 2 and 14 hours, preferably in the range of about 4-8 hours.

The carbon dioxide utilized according to the present invention should be a subcritical fluid (critical point 31° C. and 1070 psi), e.g., a liquid. In practicing the process of the present invention, carbon dioxide temperature, pressure, or both can be adjusted to ensure that it is a subcritical fluid, for example, by an inlet heat exchanger (not shown). The run pressure was held essentially constant (in the range of between about 1000 and 2200 psi) for a given run. Runs were performed at essentially constant temperatures ranging between about 0° C. and 24° C. Although a range of mass of subcritical fluid: mass of tobacco ratios can be used, typically between 21 to 50 grams of carbon dioxide per gram of tobacco were used to reduce the maximum amount of constituent.

Table 1 shows data on the reduction of constituents in tobacco employing the laboratory-scale system described above. As shown in Table 1, the process is selective for the reduction of secondary alkaloids relative to primary alkaloids.

TABLE 1

Reduction of constituents in tobacco with carbon dioxide

| Sample | Conditions (° C./psi) | pH | Mass of $CO_2$:Mass of Tobacco | % Moisture Content | % Secondary Alkaloids Reduction | % Primary Alkaloids Reduction |
|---|---|---|---|---|---|---|
| 1 | 17/1200 | 6 | 21 | 15 | 39 | 4 |
| 2 | 17/1200 | 6 | 23 | 30 | 81 | 0 |
| 3 | 14/1200 | 6 | 24 | 52 | 74 | 0 |
| 4 | 19/1200 | 8 | 50 | 58 | 91 | 2 |

Example 2

Reduction of Constituents Using Subcritical Freon 22

Additional experiments according to the method of Example 1 were carried out using Freon 22 (chlorodifluoromethane) (critical point 96° C., 716 psi) instead of carbon dioxide. The data are shown in Table 2. Exemplary conditions for use of Freon 22 include 0 to 50° C., 100 to 2000 psi, and a mass of Freon 22 to mass of tobacco ratio of 20 to 100.

TABLE 2

Reduction of constituents in tobacco with Freon 22

| Sample | Conditions (° C./psi) | pH | Mass of Freon 22:Mass of Tobacco | % Moisture Content | % Secondary Alkaloids Reduction | % Primary Alkaloids Reduction |
|---|---|---|---|---|---|---|
| 1 | 27/1200 | 6 | 53 | 15 | 65 | 52 |
| 2 | | 6 | | 55 | 98 | 77 |
| 3 | 34/1000 | 8 | 33 | 55 | 95 | 44 |

Example 3

Reduction of Secondary Alkaloids Using Subcritical Propane

Additional experiments according to the method of Example 1 were carried out using propane (critical point 96.7° C., 617 psi) instead of carbon dioxide. The data are shown in Table 3. In general, the conditions for use of propane are 0 to 50° C., 100 to 2000 psi, and a mass of propane to a mass of tobacco ratio of 20 to 100.

TABLE 3

Reduction of secondary alkaloids in tobacco with propane

| Sample | Conditions (° C./psi) | pH | Mass of Propane:Mass of Tobacco | % Moisture Content | % Secondary Alkaloids Reduction | % Primary Alkaloids Reduction |
|---|---|---|---|---|---|---|
| 1 | 20/1200 | 6 | 22 | 15 | 13 | 10 |
| 2 | 20/1200 | 6 | 22 | 60 | 58 | 3 |
| 3 | 20/1200 | 8 | 25 | 60 | 51 | 67 |

Example 4

Reduction of PAHs Using Subcritical Propane

Table 4 shows data from an experiment according to Example 1 on the reduction of PAHs in tobacco by treatment with subcritical propane.

TABLE 4

Reduction of PAHs in tobacco with propane

| Sample | Conditions (° C./psi) | pH | Mass of Propane:Mass of Tobacco | % Moisture Content | % PAHs Reduction | % Primary Alkaloids Reduction |
|---|---|---|---|---|---|---|
| 1 | 30/1000 | 6 | 24 | 16 | 77 | 14 |

Example 5

Reduction of Constituents Using Other Subcritical Fluids

The amount of constituents in tobacco may also be reduced using the methods of the invention by employing ethane (critical point 32.2° C., 708 psi) or nitrous oxide (critical point 36.5° C., 1046 psi). Exemplary conditions for use of ethane include 0 to 30° C., 500 to 2000 psi, and a mass of ethane to a mass of tobacco ratio of 20 to 100. Exemplary conditions for use of nitrous oxide include 0 to 35° C., 500 to 2000 psi, and a nitrous oxide to tobacco ratio of 20 to 100.

OTHER EMBODIMENTS

The description of the specific embodiments of the methods and tobacco obtained therefrom is presented for the purposes of illustration. It is not intended to be exhaustive nor to limit the scope of the invention to the specific forms described herein. Although the invention has been described with reference to several embodiments, it will be understood by one of ordinary skill in the art that various modifications can be made without departing from the spirit and the scope of the invention, as set forth in the claims.

Other embodiments are within the claims.

What is claimed is:

1. A method of reducing an amount of a constituent in tobacco, said method comprising the steps of:

(a) providing a vessel containing said tobacco comprising said constituent;

(b) contacting said tobacco with a subcritical fluid consisting of carbon dioxide or a hydrocarbon under conditions so that said amount of said constituent dissolves in said subcritical fluid, wherein said subcritical fluid is carbon dioxide at 0-24° C. and 1000-2200 psi and the tobacco of step (a) has a moisture content of at least 30%; said subcritical fluid is ethane at 0-30° C. and 500-2000 psi; said subcritical fluid is propane at 0-50° C. and 100-2000 psi and the tobacco of step (a) has a moisture content of at least 30%; or said subcritical fluid is Freon 22 at 0-50° C. and 100-2000 psi; or said subcritical fluid is butane and the tobacco of step (a) has a moisture content of at least 30%; and (c) removing said subcritical fluid from said vessel;

thereby reducing the amount of said constituent in said tobacco.

2. A method of selectively reducing an amount of a secondary alkaloid relative to a primary alkaloid in tobacco, said method comprising the steps of:

(a) providing a vessel containing said tobacco comprising said secondary alkaloid and said primary alkaloid;

(b) contacting said tobacco with a subcritical fluid under conditions so that a greater amount of said secondary alkaloid relative to said primary alkaloid dissolves in said subcritical fluid, wherein said subcritical fluid is carbon dioxide at 0-24° C. and 1000-2200 psi and the tobacco of step (a) has a moisture content of at least 30%; said subcritical fluid is ethane at 0-30° C. and 500-2000 psi; said subcritical fluid is propane at 0-50° C. and 100-2000 psi and the tobacco of step (a) has a moisture content of at least 30%; said subcritical fluid is Freon 22 at 0-50° C. and 100-2000 psi; or said subcritical fluid is butane and the tobacco of step (a) has a moisture content of at least 30%; and (c) removing said subcritical fluid from said vessel, thereby selectively reducing the amount of said secondary alkaloid relative to said primary alkaloid in said tobacco.

3. A method of reducing an amount of a polycyclic aromatic hydrocarbon (PAH) in tobacco, said method comprising the steps of:

(a) providing a vessel containing said tobacco comprising said PAH;

(b) contacting said tobacco with a subcritical fluid under conditions so that said amount of said PAH dissolves in said subcritical fluid, wherein said subcritical fluid is carbon dioxide at 0-24° C. and 1000-2200 psi and the tobacco of step (a) has a moisture content of at least 30%; said subcritical fluid is ethane at 0-30° C. and 500-2000 psi; said subcritical fluid is propane at 0-50° C. and 100-2000 psi and the tobacco of step (a) has a moisture content of at least 30%; said subcritical fluid is Freon 22 at 0-50° C. and 100-2000 psi; or said subcritical fluid is butane and the tobacco of step (a) has a moisture content of at least 30%; and (c) removing said subcritical fluid from said vessel;

thereby reducing the amount of said PAH in said tobacco.

4. A method of selectively reducing an amount of a PAH relative to a primary alkaloid in tobacco, said method comprising the steps of:

(a) providing a vessel containing said tobacco comprising said PAH and said primary alkaloid;

(b) contacting said tobacco with a subcritical fluid under conditions so that a greater amount of said PAH relative to said primary alkaloid dissolves in said subcritical fluid, wherein said subcritical fluid is carbon dioxide at 0-24° C. and 1000-2200 psi and the tobacco of step (a) has a moisture content of at least 30%; said subcritical fluid is ethane at 0-30° C. and 500-2000 psi; said subcritical fluid is propane at 0-50° C. and 100-2000 psi and the tobacco of step (a) has a moisture content of at least 30%; said subcritical fluid is Freon 22 at 0-50° C. and 100-2000 psi; or said subcritical fluid is butane and the tobacco of step (a) has a moisture content of at least 30%; and (c) removing said subcritical fluid from the vessel, thereby selectively reducing the amount of said PAH relative to said primary alkaloid in said tobacco.

5. A method of reducing an amount of a constituent in tobacco, said method comprising the steps of:

(a) providing a system comprising a plurality of connected vessels containing said tobacco comprising said constituent;

(b) contacting tobacco in a first vessel with a subcritical fluid under conditions so that said amount of said constituent dissolves in said subcritical fluid, wherein said subcritical fluid is carbon dioxide at 0-24° C. and 1000-2200 psi and the tobacco of step (a) has a moisture content of at least 30%; said subcritical fluid is ethane at 0-30° C. and 500-2000 psi; said subcritical fluid is propane at 0-50° C. and 100-2000 psi and the tobacco of step (a) has a moisture content of at least 30%; said subcritical fluid is Freon 22 at 0-50° C. and 100-2000 psi; or said subcritical fluid is butane and the tobacco of step (a) has a moisture content of at least 30%;

(c) removing said subcritical fluid from said first vessel; and (d) directing said subcritical fluid to a second vessel;

thereby reducing the amount of said constituent in said tobacco in said first vessel.

6. The method of claim 5, further comprising the steps, before, during, or after step (c) of:

(i) isolating said first vessel from said system; and (ii) removing said tobacco from said first vessel.

7. The method of claim 5, wherein in step (d), said subcritical fluid is that of step (c).

8. The method of any of claims 1-5, wherein in step (b), said subcritical fluid is a liquid.

9. The method of claim 8, wherein said liquid is a compressed gas.

10. The method of any of claims 1-5, wherein in step (b), said subcritical fluid is a compressible gas.

11. The method of claim 1, further comprising, after step (c), the step of separating said constituent from said subcritical fluid.

12. The method of claim 2, further comprising, after step (c), the step of separating said secondary alkaloid from said subcritical fluid.

13. The method of claim 3 or 4, further comprising, after step (c), the step of separating said PAH from said subcritical fluid.

14. The method of claim 11, wherein said separating comprises flowing said fluid containing said constituent from step (c) into a separator vessel containing a substance capable of separating said constituent from said subcritical fluid.

15. The method of claim 14, wherein said substance comprises citric acid or magnesium silicate.

16. The method of claim 12, wherein said separating comprises flowing said fluid containing said secondary alkaloid from step (c) into a separator vessel containing a substance capable of separating said secondary alkaloid from said subcritical fluid.

17. The method of claim 16, wherein said substance comprises citric acid or magnesium silicate.

18. The method of claim 13, wherein said separating comprises flowing said fluid containing said PAH from step (c) into a separator vessel containing a substance capable of separating said PAH from said subcritical fluid.

19. The method of claim 11, wherein said separating comprises flowing said subcritical fluid containing said constituent from step (c) into a separator vessel, wherein said subcritical fluid undergoes a change in pressure or temperature and said constituent precipitates.

20. The method of claim 12, wherein said separating comprises flowing said subcritical fluid containing said secondary alkaloid from step (c) into a separator vessel, wherein said subcritical fluid undergoes a change in pressure or temperature and said secondary alkaloid precipitates.

21. The method of claim 13, wherein said separating comprises flowing said subcritical fluid containing said PAH from step (c) into a separator vessel, wherein said subcritical fluid undergoes a change in pressure or temperature and said PAH precipitates.

22. The method of claim 11, further comprising, after said separating, the step of recirculating said subcritical fluid to said vessel.

23. The method of claim 12, further comprising, after said separating, the step of recirculating said subcritical fluid to said vessel.

24. The method of claim 13, further comprising, after said separating, the step of recirculating said subcritical fluid to said vessel.

25. The method of claim 22, wherein during said recirculating, flavor or aroma compounds removed in step (b) are deposited in said tobacco after step (c).

26. The method of claim 23, wherein during said recirculating, flavor or aroma compounds removed in step (b) are deposited in said tobacco after step (c).

27. The method of claim 24, wherein during said recirculating, flavor or aroma compounds removed in step (b) are deposited in said tobacco after step (c).

28. The method of any of claims 1-5, wherein said subcritical fluid is carbon dioxide at 0-24° C. and 1000-2200 psi, and the tobacco of step (a) has a moisture content of at least 30%.

29. The method of any of claims 1-5, wherein the subcritical fluid is ethane at 0-30° C. and 500-2000 psi or Freon 22 at 0-50° C. and 100-2000 psi, and the tobacco of step (a) has a moisture content of at least 20%.

30. The method of claim 1, 3, 4 or 5, wherein the pH of said tobacco in step (a) is between 4 and 9.

31. The method of claim 1 or 5, wherein said constituent is a PAH.

32. The method of claim 1 or 5, wherein said constituent is a secondary alkaloid.

33. The method of claim 5, further comprising after step (c), the step of separating said constituent from said subcritical fluid.

34. The method of claim 33, wherein said second vessel in step (d) contains a substance capable of separating said constituent from said subcritical fluid.

35. The method of claim 34, wherein said substance comprises citric acid or magnesium silicate.

36. The method of claim 33, wherein said subcritical fluid in the second vessel undergoes a change in pressure or temperature and said constituent precipitates.

37. The method of claim 33, further comprising, after said separating, the step of recirculating said subcritical fluid to the first vessel.

38. The method of claim 37, wherein during said recirculating, flavor or aroma compounds removed in step (b) are redeposited in said tobacco after step (c).

39. The method of claim 1, wherein the subcritical fluid is carbon dioxide at 0-24° C. and 1000-2200 psi, propane at 0-50° C. and 100-2000 psi, or butane, and the tobacco of step (a) has a moisture content of at least 40%.

40. The method of claim 39, wherein the subcritical fluid is carbon dioxide at 0-24° C. and 1000-2200 psi, propane at 0-50° C. and 100-2000 psi, or butane, and the tobacco of step (a) has a moisture content of at least 50%.

41. The method of claim 1, wherein the subcritical fluid is ethane at 0-30° C. and 500-2000 psi or Freon 22 at 0-50° C. and 100-2000 psi, and the tobacco of step (a) has a moisture content of at least 30%.

42. The method of claim 1, wherein the subcritical fluid is ethane at 0-30° C. and 500-2000 psi or Freon 22 at 0-50° C. and 100-2000 psi, and the tobacco of step (a) has a moisture content of at least 40%.

43. A method of selectively reducing an amount of a secondary alkaloid relative to a primary alkaloid in tobacco, said method comprising the steps of:

(a) providing a vessel containing said tobacco comprising said secondary alkaloid and said primary alkaloid;

(b) contacting said tobacco with a subcritical fluid under conditions so that a greater amount of said secondary alkaloid relative to a said primary alkaloid dissolves in said subcritical fluid;

(c) removing said subcritical fluid from said vessel, (d) separating said secondary alkaloid from the subcritical fluid in step (c), wherein said separating comprises flowing the subcritical fluid containing said secondary alkaloid from step (c) into a separator vessel containing a substance capable of separating said secondary alkaloid from the subcritical fluid, wherein the substance comprises citric acid or magnesium silicate;

thereby selectively reducing the amount of said secondary alkaloid relative to said primary alkaloid in said tobacco.

* * * * *